United States Patent [19]

Chalabian

[11] 4,183,426

[45] Jan. 15, 1980

[54] VENDING MACHINE WITH REMOVABLE COIN OPERATED MECHANISM

[75] Inventor: Jack S. Chalabian, Gardena, Calif.

[73] Assignee: K-Jack Engineering Company, Inc., Gardena, Calif.

[21] Appl. No.: 818,121

[22] Filed: Jul. 22, 1977

[51] Int. Cl.[2] ..... G07F 5/08

[52] U.S. Cl. ..... 194/67

[58] Field of Search ..... 194/57, 59, 54, 1 K, 194/1 G, 10, 65, 1 L, 2, 1 R, 1 B, 1 E, 51, 102, 100 A, 100 R, 97 R, 67

[56] References Cited

U.S. PATENT DOCUMENTS

| | | | |
|---|---|---|---|
| 2,865,698 | 12/1958 | Smith | 194/1 L |
| 3,279,574 | 10/1966 | Seiden | 194/97 |
| 3,503,482 | 3/1970 | Davis | 194/54 |
| 3,870,136 | 3/1975 | Voegeli | 194/54 |

*Primary Examiner*—Stanley H. Tollberg

*Attorney, Agent, or Firm*—Smyth, Pavitt, Siegemund, Jones & Martella

[57] ABSTRACT

A vending machine having an enclosure for articles to be vended, a lockable door to the enclosure and a coin operated locking mechanism to unlock the door when a predetermined combination of coins is placed in the coin operated mechanism. A coin mechanism enclosure includes releasable support which is engageable with the coin operated mechanism to hold the mechanism in a predetermined position to control the opening of the door. Structure is provided to release the coin mechanism from the support to remove the coin mechanism from the coin mechanism enclosure.

A vending machine having an enclosure for articles to be vended, a lockable door to the enclosure and a coin operated locking mechanism to unlock the door when a predetermined combination of coins is received by the mechanism. A latch member is supported by the door with the latch member being engageable with a keeper within the coin mechanism when the door is locked. During closing of the vending machine door, the forward end of the latch member engages the keeper which causes deflection of the latch member such that the latch member passes over the keeper. The latch member is supported by a support bracket whose resistance to bending increases in a direction proceeding away from the point of attachment of the latch member to the support bracket. The support bracket, thus, has increased resistance to bending forces from contact of the latch member with the keeper and tends to maintain the position of the latch member with respect to the keeper during long-term usage of the vending machine.

15 Claims, 6 Drawing Figures

12
19
26
24
70
28
20
140
36
40
46
42
83
17
18
48
49
132
20
135
137
96
108
106
137
142
104
102
10
144
112
118
114
110
116
120
119
81
136
134
80
148
84
92
127
131
128
18
130
90
122
124
126

VENDING MACHINE WITH REMOVABLE COIN OPERATED MECHANISM

BACKGROUND OF THE INVENTION

Coin-operated vending machines are known in which newspapers or magazines are displayed within a lockable enclosure having a door which may be unlocked by inserting a predetermined combination of coins into a coin mechanism associated with the vending machine. In this regard, reference is made to my prior U.S. Pat. No. 3,844,330, which illustrates a coin-operated vending machine that may be used for the sale of newpapers.

As described in my prior patent, the opening of the door to the vending machine may be controlled by inserting a predetermined combination of coins into a coin slot of the coin mechanism. A latch member is mounted on the vending maching door and engages a keeper within the coin mechanism when the door is locked. However, when the required combination of coins is inserted in the mechanism, the coins form a column which may bear against a cam surface formed on the latch member. On movement of the latch member relative to the column of coins, the coins contact the cam surface on the latch member to cause the latch member to be deflected downwardly such that a finger or tooth on the latch member fails to engage the keeper such that the door can be opened. As the door to the vending machine is opened, the column of coins is permitted to drop into a coin receptacle. Following this, a newspaper may be removed from the vending machine and the door may then again be closed with the latch member cooperating with the keeper to prevent opening of the door until the required combination of coins is again inserted into the coin mechanism, etc.

During usage of a vending machine, as described in my prior U.S. Pat. No. 3,884,330, the vending machine may be subjected to considerable abuse. For example, the machine may be subjected to tampering in an attempt to recover coins from the coin receptacle. Also, slugs may be deposited in the coin mechanism in an attempt to open the vending machine. Also, there may be abuse of the vending machine during usage, by, for example, slamming the door of the vending machine.

Due to the harsh usage received by the vending machine, it may be necessary to repair the machine from time to time. At present, it is difficult to repair the coin mechanism for the vending machine since the coin mechanism and the enclosure for the coin mechanism form a single unit which must be removed in its entirety during repair and replaced with a new unit. Thus, it would be desirable if a vending machine could be provided in which the coin mechanism could be more easily repaired without having to remove the entire coin mechanism and the coin mechanism enclosure from the vending machine.

One form of rough usage which is received by a vending machine results from slamming of the vending machine door. In a vending machine of the type illustrated in my prior U.S. Pat. No. 3,884,330, the latch member, which is supported by the vending machine door, is deflected downwardly through contact with the keeper during closing of the vending machine door. If the door is slammed shut, as may frequently be the case, the force exerted against the latch member during closing of the door may be sufficient to bend the support for the latch member to permanently alter the position of the latch member. With the position of the latch member being permanently altered, the latch member may fail to engage the keeper when the door is closed. The door may, then, be opened by merely pulling on the door with the latch member riding over the keeper. With the locking action of the vending machine door being permanently impaired by, thus, altering the position of the latch member, the vending machine may cease to function for its desired purpose to prevent the unauthorized removal of newspapers from the vending machine.

In view of the difficulties which are encountered in usage of vending machines due to slamming of the vending machine door, it would be desirable if a vending machine could be provided in which the support for the latch member had a greater resistance to deformation by bending. This would prevent a change in the position of the latch member such that the vending machine would remain functional in locking of the vending machine door even after repeated slamming of the door.

SUMMARY OF THE INVENTION

The present invention provides a coin-operated vending machine in which the coin mechanism may be readily removed from the coin mechanism enclosure for servicing. The vending machine includes an enclosure for articles to be vended, a lockable door to the enclosure, and a coin-operated locking mechanism which unlocks the door when a predetermined combination of coins is received by the mechanism. Additionally, the machine includes a coin mechanism enclosure and releasable support means within the enclosure which is engageable with the coin mechanism to hold the mechanism in a predetermined position within the enclosure to control opening of the vending machine door. Also, the vending machine includes means to release the support means to permit removal of the coin mechanism from the coin mechanism enclosure.

The means to release the support means may include a locking member which is movable between a locking position and an unlocking position. The locking member in its locking position may exert a force against the coin-operated locking mechanism to move the mechanism into fixed engagement with the support means. The coin mechanism, thus, occupies a predetermined position to control the opening of the vending machine door. However, with the locking member in its unlocking position, the coin mechanism may be moved out of fixed engagement with the support means to permit the removal of the coin mechanism from the coin mechanism enclosure.

The support means for the vending machine may include support posts which are fixedly positioned with respect to the coin mechanism enclosure. Apertures may be provided in the coin mechanism with the apertures having a configuration which provides fixed engagement with the support posts when the coin mechanism is shifted in one direction relative to the support posts. Additionally, the configuration of the apertures may be such as to permit disengagement of the apertures from the support posts when the coin mechanism is shifted in another direction relative to the support posts.

The locking member may be mounted on the coin mechanism enclosure for contact with the coi mechanism. Also, the locking member may have a cam surface which contacts the coin mechanism to cause movement of the coin mechanism into fixed engagement with the support means when the locking member is moved to its locking position.

In controlling the locking and unlocking of the vending machine door, the vending machine may include a latch member on the door and a keeper member with the latch member engaging the keeper member with the door in a locked position. The coin mechanism may include a coin chute which may retain a plurality of coins in a columnar relation. Means may be provided to prevent upward movement of the coins within the coin chute when a predetermined number of coins of predetermined denomination have been inserted into the chute.

Cam means on the latch member may contact the lower most coin of the plurality of coins on movement of the latch member relative to the coins. This contact may deflect the latch member away from the keeper member when the predetermined combination of coins has been inserted into the chute to permit opening of the vending machine door. The releasable support means may position the coin mechanism within the coin mechanism enclosure with the keeper member and coin chute positioned in a predetermined relation with respect to the latch member. This relation may provide engagement between the keeper member and latch member with the door in a locked condition while permitting opening of the door when a predetermined combination of coins has been inserted into the chute.

The means for preventing upward movement of the plurality of coins within the coin chute to permit unlocking of the vending machine door may include a plurality of pawls within the coin mechanism. The pawls may be positioned for movement into the coin chute to engage the uppermost coin of the plurality of coins when the predetermined combination of coins has been inserted into the chute. Releasable control means may be provided to change the position of the pawls to vary the predetermined combination of coins which are required to unlock the door. The releasable control means may engage the pawls when the coin mechanism is in fixed engagement with the support means. However, the releasable control means may be disengaged from the pawls with movement of the coin mechanism from engagement with the support means during removal of the coin mechanism from the coin mechanism enclosure.

Additionally, the invention provides a vending machine with an enclosure for articles to be vended, a lockable door to the enclosure, a coin-operated mechanism to unlock the door when a predetermined combination of coins is received by the mechanism, a latch member mounted on the door and a keeper which engages the latch member with the door in a locked position. The latch member may have an inclined forward surface which contacts the keeper during closing of the vending machine door. Contact between the keeper and the forward surface may cause deflection of the latch member so that the latch member rides over the keeper as the door is closed while minimizing the impact force between the keeper and the forward end of the latch member. A support bracket may be connected to the door with the latch member being movably supported by the support bracket. The support bracket may have a cross-sectional configuration which provides a relatively high resistance to bending. Thus, the position of the latch member relative to the keeper member when the vending machine door is in a closed position may be maintained relatively constant during long-term usage of the vending machine.

The support member for the vending machine may have a generally U-shaped cross section with spaced-apart legs and the latch member may be rotatably mounted between the legs. Additionally, spring means may resiliently bias the latch member to a position to contact the keeper when the door is in a locked position. The cross-sectional area of the support member may progressively increase in a direction toward the vending machine door from the point of connection between the support member and the latch member. To provide a cross section for the support member which progressively increases in the direction of the vending machine door, the legs for the support member may have a depth which progressively increases in the direction of the door with the latch member being mounted on the distal end of the support member. Accordingly, bending forces which may be applied to the support member through the latch member may be resisted by the support member with a progressively increasing resistance to bending that corresponds with the increasing magnitude of the bending forces.

DESCRIPTION OF THE DRAWINGS

To illustrate a preferred embodiment of the invention, reference is made to the accompanying drawings in which.

DETAILED DESCRIPTION

Figure 1:
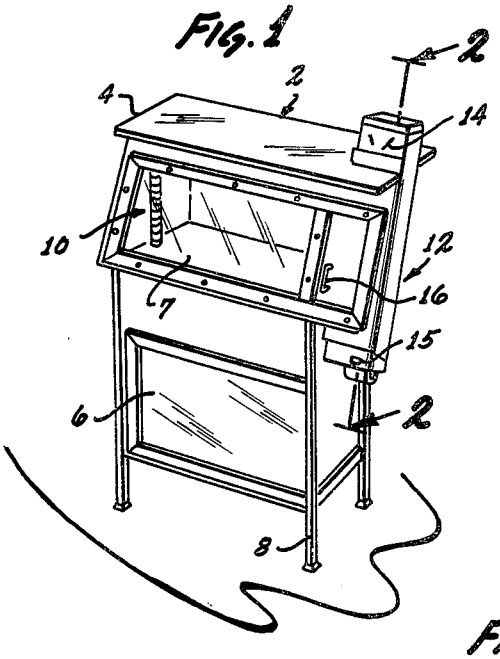
FIG. 1 is a perspective view of a coin-operated vending machine with a coin mechanism which controls opening of the vending machine door when a predetermined combination of coins is inserted into the mechanism.

As shown in FIG. 1, a vending machine 2 may include a display compartment 4 with a storage compartment 6 positioned beneath the display compartment. Newspapers may, for example, be placed within the storage compartment 6 on a support plate 7 which is spring-biased to a raised position. With newspapers resting on the support plate 7, the plate may then be forced to the bottom of the storage compartment 6 by the weight of the newspapers. However, as newspapers are successively removed from the support plate 7, the weight of the newspapers aginst the support plate is reduced and the plate may move upwardly to present additional newspapers within the display compartment 4.

The vending machine 2 may include a plurality of legs 8 and a lockable door 10 to provide access to the display compartment 4. The unlocking of the door 10 may be controlled by a coin mechanism 12 having coin slots 14 therein and a coin return opening 15. When a predetermined combination of coins of predetermined number and denomination have been inserted into coin slots 14, the vending maching door 10 may be unlocked and opened by exerting a pulling force against a handle 16 that is positioned on the front of the door. After opening the door 10, a newspaper may then be removed from the display compartment 4 and the door may then be closed and returned to its locked position.

Figure 2:
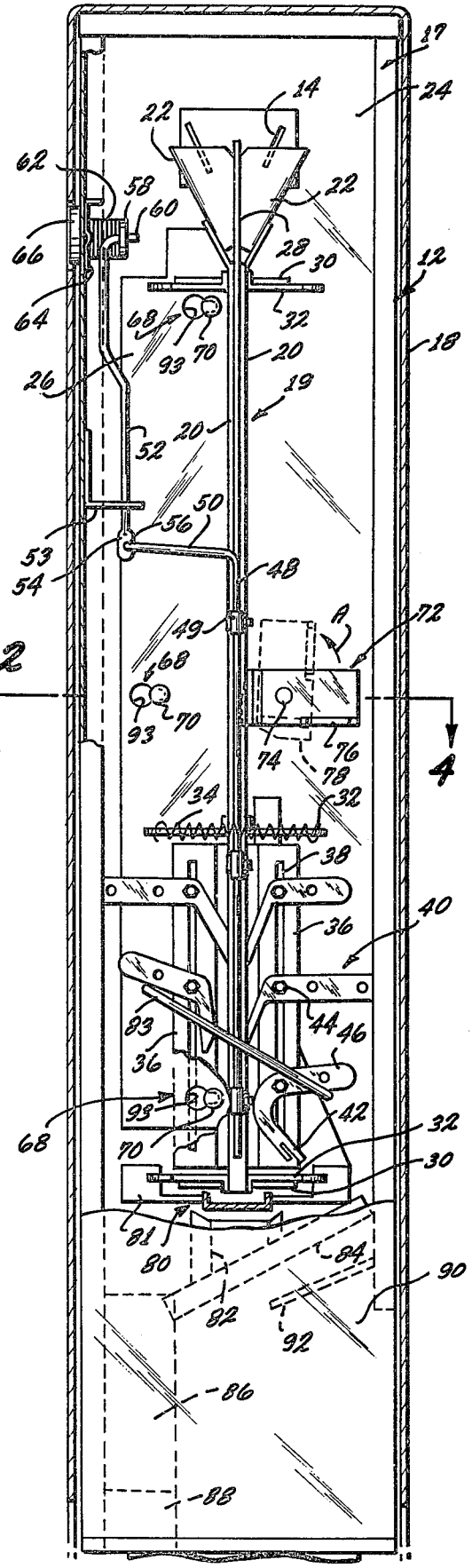
FIG. 2 is a sectional view taken along the line 2—2 of FIG. 1 which illustrates the positioning of the coin mechanism in fixed engagement with the coin mechanism enclosure through action of a locking member.

Turning to FIG. 2, which is a sectional view taken along line 2—2 of FIG. 1, the coin mechanism 12 may be encased within an armored shroud 18 to prevent tampering with the coin mechanism by thieves or vandals. The overall coin mechanism 12 may include an enclosure structure 17 and a mechanism 19 which is positioned within the enclosure structure. The mechanism 19 may include coin chutes 20 which are connected to coin funnels 22. As illustrated, coins which are inserted through the coin slots 14 pass into the funnels 22 and then into the coin chutes 20. A support surface 24 within the enclosure structure 17 may be in bearing relation with a support plate 26 which forms a part of the mechanism 19.

The suppcrt plate 26 may be formed integrally with an upstanding common wall 28 which, taken together, form a structure with an L-shaped configuration. A plurality of support members 30 may be fixedly connected to the common wall 28 with spring arms 32 being rotatably supported by the support members for rotation of the spring arms in an outward direction away from the common wall. A spring 34 may connect the extremities of each pair of spring arms 32 with the spring urging the spring arms in a rotational direction toward the common wall 28. Only one spring 34 is shown in FIG. 2; however, additional springs may be provided between the other pairs of spring arms 32 if it is desired to increase the force urging the spring arms in the direction of the common wall 28. Pawl support brackets 36 may be fixedly connected to the common wall 28 with the pawl support brackets each having a slot 38 with a plurality of pawls 40 being mounted within the slot. Each of the pawls 40 may include a pawl finger 42 which extends through a longitudinal aperture (not shown in FIG. 2) in the coin chute 20 which is adjacent to the pawl. As shown, each of the pawls 40 is pivotally mounted within one of the slots 38 by means of a pivot 44. Additionally, each of the pawls 40 has a counter-weighted end 46 which urges the pawl finger 42 into the slot within the adjacent coin chute 20.

A control rod 48 may be movably supported within a plurality of rod guides 49 with the control rod having a laterally bent portion 50 which is releasably connected to a rod 52. The rod 52 is supported adjacent its lower end by a rod guide 53 with an eye 54 being formed at the lower end of the rod for releasable engagement with a hook 56 formed at the end of the bent portion 50.

A rotatable eccentric 58 is connected to a hook 60 formed at the upper end of the rod 52. The rod 52, as illustrated in FIG. 2, may be bent in a lateral direction to prevent interference between the rod and the rotational movement of the eccentric 58. The eccentric 58 is rotatably mounted within a lock 62 which is fixedly connected to the enclosure structure 17 by a mounting member 64 with rotational movement of the eccentric causing vertical movement of the rod 52 and control rod 48. Aligned openings formed in the armored shroud 18 and the enclosure structure 17, which are referred to collectively as 66, provide access to the lock 62 such that a key may be inserted in the lock from the exterior of the armored shroud to rotate the eccentric 58 in varying the position of the control rod 48.

A plurality of irregularly shaped apertures 68 are provided in the support plate 26 with the apertures engaging support posts 70 which are fixedly connected to the surface 24. A locking member 72 is rotatably connected to the surface 24 by a pivot 74 with the locking member having a handle 76 which may be grasped to cause rotational movement of the locking member. A cam surface 78 may be formed at the end of the locking member 72. By rotating the locking member 72 in the direction indicated by the arrow A, the locking member may be moved from its position indicated in solid line drawing to that indicated in phantom line drawing. During this movement, the cam surface 78 may be moved out of contact with the common wall 28. However, by rotating the locking member 72 from its position shown in phantom line drawing in a direction opposite to that indicated by the arrow A, the cam surface 78 may be brought into contact with the common wall 28. This may exert a sideward force upon the mechanism 19 which may shift the mechanism in a sideward direction to the shifted position shown in FIG. 2. In its shifted position, the mechanism 19 is fixedly connected to the support surface 24 through contact of the posts 70 with the irregularly shaped apertures 68 in the support plate 26.

With the vending machine door 10 in a closed position as indicated in FIG. 1, a movable latch member 80, which is supported on the door, is positioned within an opening in the enclosure structure 17. In moving into the opening in the enclosure structure 17, the latch member 80 may pass over a keeper 81 through deflection of the latch member by contact with the keeper. However, on passing over the keeper 81, the configuration of the latch member 80 prevents the movement of the latch member in an opposite direction with respect to the keeper. The vending machine door 10 is then locked and cannot be opened until a predetermined combination of coins has been inserted within the coin mechanism 12.

Coins which are inserted into the coin mechanism 12 pass through the coin slots 14 into the coin funnels 22 and into the coin chutes 20. The coins within the coin chutes 20 are positioned in a columnar edge-to-edge relation with the lowermost coin or coins resting on the upper surface of the latch member 80. During the passage of the coins through coin chutes 20, the coins contact the pawl fingers 42 of selected pawls 40 whose fingers extend through a slot into the coin chutes, as previously described. Certain of the pawls 40 may be rendered inoperative through contact with a rod 83 which is connected to the control rod 48. In its position as illustrated in FIG. 2, the rod 83 contacts the lowermost pawls on either side of the common wall 28. The contact of the rod 83 causes rotational movement of those particular pawls 40 to move the pawl fingers 42 of the contacted pawls out of the coin chutes 20. However, the pawls 40 which are not contacted by rod 83 are urged by their respective counter-weights 46 to a rotational position which places the respective pawl fingers 42 within the adjacent coin chutes 20.

During the movement of coins through coin chutes 20, the coins may contact the pawl fingers 42 which extend into the coin chutes, with the fingers being moved out of the coin chutes 20 by the weight of the coins as the coins pass by the pawl fingers. After the coins have passed by the pawl fingers 42, the pawls 40 may then undergo rotation through the force provided by counter-weights 46 such that the pawl fingers again extend into the coin chutes 20. A slot or slots (not shown) may be formed in the common wall 28 to interconnect the coin chutes 20 such that a pawl finger 42 may extend into both of the chutes to contact a column of coins in each of the chutes.

When the proper combination of coins has been inserted into the coin chutes 20, as required for the purchase of a single newspaper, the coins are positioned in a columnar arrangement within the coin chutes. The uppermost coin in the column is positioned immediately below a pawl finger 42 such that the pawl finger prevents upward movement of the column of coins within the coin chute 20. As will be described, a cam surface is formed on the latch member 80. When upward movement of the coins within the coin chutes 20 is prevented through action of the pawls 40, as described, the column of coins within the coin chutes acts against the cam surface on the latch member 80 as the latch member is moved outwardly by movement of the vending machine door 10. This causes a downward deflection of the latch member 80 such that a hook on the latch member passes beneath the keeper 81 to unlock the vending machine door 10.

When an incorrect combination of coins is inserted into the coin mechanism 12, the coins are not held against upward movement within the coin chutes 20 by the action of the pawls 40. Rather, the height of an incorrect combination of coins within the chutes 20 will be either too high or too low in relation to the position of the pawls 40 to prevent upward movement of the column of coins. If the height of the coins within the chutes 20 is too high, the coins will inactivate the pawls 40 by forcing the pawl fingers 42 out of the coin chutes 20. Conversely, if the height of coins within the coin chutes 20 is too low in relation to the pawls 40, the coins will be permitted upward movement within the coin chutes before contacting the pawl fingers 42. Thus, when the height of the coins within the chutes 20 is either too high or too low with respect to the position of the pawls 40, the coins will not act as a fixed column to cause downward deflection of the latch member 80 such that the latch member will clear the keeper 81 to unlock the door 10.

When the combination of coins inserted in the coin chutes 20 is incorrect, as described, the coins within the chutes will move upwardly if an attempt is made to open the door 10 and to withdraw the latch member 80 from the enclosure 17. The latch member 80 then engages the keeper 81 to prevent opening of the door 10. As described in my U.S. Pat. No. 3,884,330, the keeper 81 may be interconnected with the coin chutes 20 with the keeper being biased to its normal position shown in FIG. 2 under the action of a biasing spring. When a force is applied against the keeper 81 by latch member 80, as when the combination of inserted coins is incorrect, the keeper may undergo a movement which is imparted to the coin chutes 20 to cause the chutes to undergo rotational movement in a direction away from the common wall 28. This, then, releases the coins from the coin chutes 20 such that the coins are permitted to fall onto an inclined baffle member 84 which conducts the coins to a coin return slot 86 and then to a coin return opening 88.

To prevent the removal of coins from the coin mechanism 12 by turning the vending machine 2 upside down, a coin box 90 is positioned below a baffle 92. The baffle 92 functions to assist in preventing the movement of coins in a reverse direction through the coin receiving opening 82, such that the coins could be transferred from the coin box 90 onto the baffle 84 and into the coin return opening 88.

Figure 3:
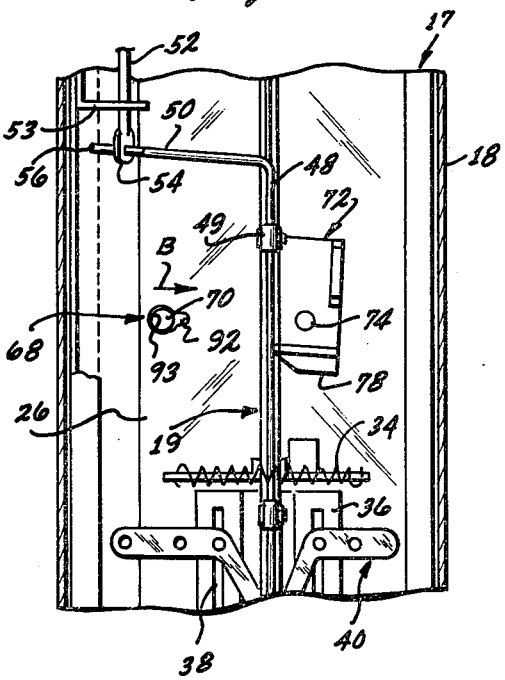
FIG. 3 is an enlarged sectional view of a portion of a coin mechanism illustrated in FIG. 2 in which the locking member is in an unlocking position to permit shifting of the coin mechanism relative to the coin mechanism enclosure for removal of the mechanism from the enclosure.

FIG. 3 is an enlarged sectional view which indicates the action of locking member 72 during removal of the mechanism 19 from the enclosure structure 17. As indicated, with locking member 72 rotated to a vertical position, the cam surface 78 is moved out of contact with the common wall 28. This permits the mechanism 19 to be shifted in the direction of the arrow B which causes the posts 70 to undergo movement within the irregularly shaped apertures 68. The posts 70, which each have an enlarged head portion, move from a small aperture portion 92 into a large aperture portion 93 which together make up the irregularly shaped apertures 68. The small aperture portions 92 are sufficiently large to accommodate the shafts of the posts 70. The heads of the posts 70 are larger than the small aperture portions, with the heads, therefore, bearing against the support plate 26 as the shafts are engaged by the small aperture portions. The heads of the support posts 70 are, however, smaller than the large aperture portions 93. Thus, after movement of the mechanism 19 in the direction of the arrow B to its position shown in FIG. 3, the mechanism may be withdrawn from the closure structure 17 with the heads of the support posts 70 passing through the large aperture portions 93.

Figure 4:
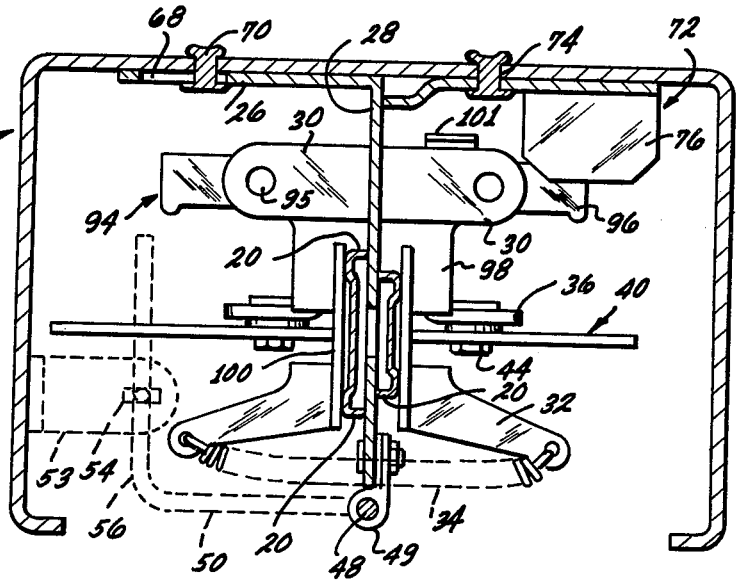
FIG. 4 is a sectional view taken along the line 4—4 of FIG. 2 which illustrates the manner in which coin chutes of the coin mechanism are releasably held against a common wall forming a closure with the coin chutes.

FIG. 4 is a partial sectional view taken along line 4—4 of FIG. 2 to illustrate the manner in which the coin chutes 20 cooperate with the common wall 28. As illustrated, the pairs of support members 30 are fixedly connected to the common wall 28 with L-shaped members 94 being pivotally connected to the support members through pivots 95. The L-shaped members 94 each include base portions 96 which extend outwardly in their normal position at approximately a right angle to the common wall 28 and leg portions 98 which in their normal position are generally parallel to the common wall. Bearing portions 100 are joined to the leg portions 98 with the bearing portions positioned at a right angle with respect to the leg portions and the bearing portions each being fixedly connected to the outer wall of an adjacent coin chute 20. The bearing portions 100 are then fixedly connected to the spring arms 32 with the plane of the spring arms being generally perpendicular to that of the bearing portions. Additionally, the spring arms 32 may generally be coplanar with the leg portions 98 and the base portions 96 of L-shaped members 94.

As indicated, the spring 34 positioned between the pairs of spring arms 32 functions to hold the spring arms, the leg portions 98 and the base portions 96 in the positions shown in FIG. 4. This, in turn, holds the coin chutes 20 in contact with the common wall 28. As described previously, when an incorrect number of coins is placed in the coin chutes 20, the latch member 80 may engage the keeper 81 such that the keeper undergoes movement to move the coin chutes 20 away from the common wall 28. The keeper 81 may undergo a limited rotational movement against the force of a biasing spring 101 which brings the keeper into contact with the adjacent pair of base portions 96 within the mechanism 19. This may, then, impart a rotational movement to the base portions 96 which is transmitted to the leg portions 98, the bearing portions 100 and the spring arms 32. The coin chutes 20 are then moved away from the common wall 28 against the force of the spring 34, such that coins within the coin chutes may be released from the chutes and returned to the user.

Figure 5:
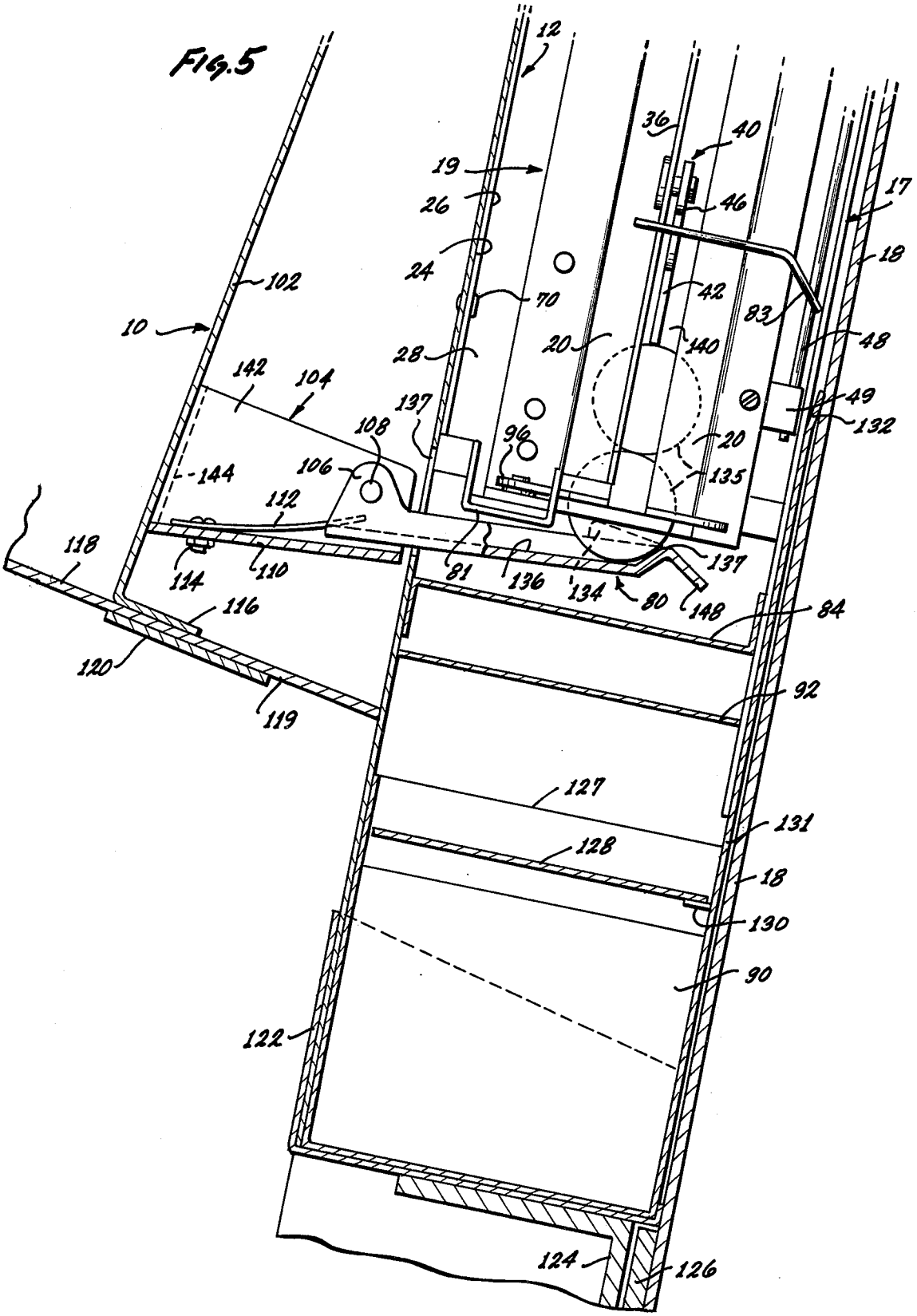
FIG. 5 is a sectional view of a portion of the coin mechanism and vending machine door as viewed from the left of FIG. 2 which illustrates the manner in which the latch member may be moved out of engagement with the keeper member when a predetermined combination of coins has been inserted into the coin chute.

FIG. 5 is a partial side sectional view of the overall coin mechanism 12 taken from the left of FIG. 2 which illustrates the manner in which the door 10 may be maintained in a locked position relative to the mechanism 19. The door 10 includes a door panel 102 having a latch support generally indicated as 104 which is fixedly connected thereto. The latch member 80 may include a mounting ear 106 having an aperture therein which engages a pivot rod 108 that is secured to the latch support 104. The latch support 104 may also include a cross member 110 with a spring 112 being secured to the cross member by a connector 114. The spring 112 bears against the latch member 80 to rotate the latch member in a counter-clockwise direction with respect to the axis of the pivot rod 108.

As indicated, the door 10 may include a flange 116 which extends at approximately a right angle to the plane of the door panel 102. With the door 10 in a closed position, the flange 116 may be nested within a support structure composed of members 118 and 119 which are joined in butting relation by a member 120. As indicated, the member 118 may extend outwardly a short distance beyond the front surface of the door 10 with the door in a closed position.

An end cap 122 may be positioned about the bottom of the enclosure structure 17 to strengthen the enclosure structure. An L-shaped lock plate 124 may then be fixedly connected to the end cap 122 with the lock plate in bearing relation with a lock plate 126 which may be secured to the armored shroud 18. The lock plate 126 and the portion of the lock plate 124 in engagement therewith may each contain apertures which, when aligned, may receive a lock to fixedly connect the plates 124 and 126 to hold the enclosure structure 17 within the armored shroud 18. The coin box 90 may have an upper edge surface 127 which is received beneath the baffle 92 and a movable baffle plate 128 may be rotatably secured to one edge of the top surface 127. The movable baffle plate 128 may be inclined downwardly within the coin box and rest on a fixed stop 130 when the box 90 is positioned as shown in FIG. 5. Due to the rotational interconnection between the movable baffle 128 and one of the edges of the top surface 127, the movable baffle may undergo rotational movement away from the stop 130 if the coin mechanism 12 is turned upside down. The free edge of the movable baffle 128 may then move into closer proximity with the adjacent wall of the coin box 90 to prevent the dislodgement of coins from the coin box.

The coin box 90 may include an upwardly extending side member 131 which extends above the top surface 127. As indicated, the upwardly extending side member 131 may include an outwardly bent end 132. The outwardly bent end 132 may engage the inner surface of the armored shroud 18 as shown in FIG. 5 to act as a spring in holding the coin box 90 firmly in place within the mechanism enclosure 17.

The latch member 80, as indicated, may have a U-shaped cross-sectional configuration with hooks 134 formed on either side of the upper surface of the latch member. The hooks 134 may engage the keeper 81 on movement of the latch member 80 to the left from its position shown in FIG. 5. In this manner the keeper 81 prevents the withdrawal of the latch member 80 through the opening 137 to open the door 10.

A plurality of coins 135 within one of the coin chutes is shown as resting on a cross member 136 of latch member 80. As illustrated, when the coins 135 are held against upward movement by a pawl finger 42 extending into a longitudinal aperture 140 in the adjacent coin chute 20, the coins act as a fixed column upon the upper surface 136 of latch member 80. On movement of the latch member 80 to the left from its position shown in FIG. 5, the coins 135 may, thus, contact a raised cam surface 137 on the latch member 80 prior to contact of the hooks 134 with the keeper 81. This causes a clockwise rotation of the latch member 80 relative to the pivot 108 such that the hooks 134 pass beneath the keeper 81 to permit opening of the door 10.

Figure 6:
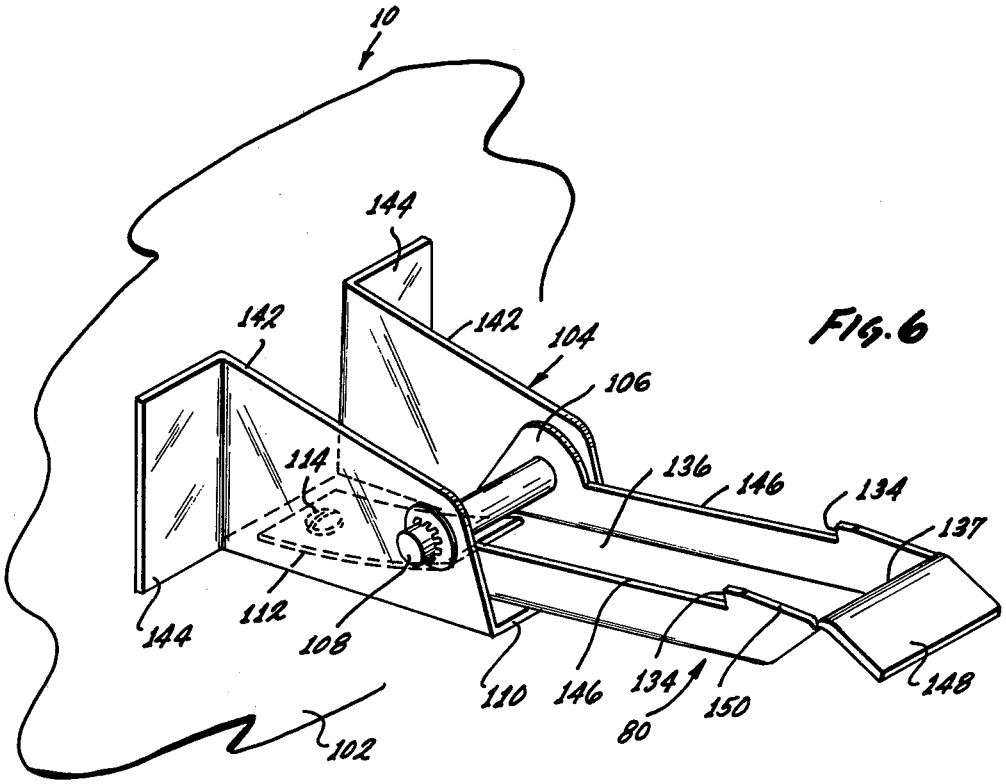
FIG. 6 is a perspective view illustrating the configuration of the latch member and the latch member support bracket which provides a high resistance to bending of the support bracket and latch member when the vending machine door is slammed shut during usage of the vending machine.

FIG. 6 is a perspective view which illustrates in detail the latch support 104 through which the latch member 80 is supported on the door 10. As illustrated, the latch support 104 has a generally U-shaped configuration formed by side members 142 joined together by the cross member 110. The side members 142 are each connected to tab members 144 which extend at approximately a right angle to the side members. As indicated, the tab members 144 may each be fixedly secured to the door panel 102 in supporting the latch support 104 relative to the door 10.

The latch member 80 also has a generally U-shaped configuration in which side members 146 are joined together by the cross member 136. The hooks 134 are formed on the upper surfaces of the side members 146, as described previously, for engagement with the keeper 81 (see FIG. 5). During closing of the door 10, as described in regard to FIG. 5, the forward end of the latch member 80 encounters the keeper 81 with the latch member 80 being deflected to pass over the keeper and to permit closing of the door. To facilitate passage of the latch member 80 past the keeper 81 in closing of the door 10, a slanted contact surface 148 may be formed at the nose of the latch member. The slanted contact surface 148 makes the first contact with the keeper 81 during closing of the door 10 so as to minimize the force of impact between the keeper and the latch member 80 and to facilitate sliding contact between the keeper and latch member as the latch member is deflected away from the keeper.

As indicated, slanted contact surfaces 150 are formed adjacent to the contact surface 148 with the slanted contact surfaces 150, in effect, forming a continuation of the contact surface 148. The position and shape of the slanted contact surfaces 150, coupled with the shape and position of the contact surface 248 further assists in providing movement of the latch member 80 past the keeper 81 during closing of the door 10. The keeper 81 first slides on the surface 148 and then on the surfaces 150 to provide deflection of the latch member 80 as the latch member and keeper undergo sliding contact relative to each other. When the latch member 80 is moved a sufficient distance relative to the keeper 81 to complete the contact between the slanted surfaces 150 and the keeper, the hooks 134 are moved beyond the keeper with the latch member then undergoing movement in the opposite direction toward the keeper under the influence of spring 112 such that the hooks are engageable by the keeper. At this point, the movement of the latch member 80 relative to the keeper 81 is essentially complete and the door 10 is in a locked position.

As described, the keeper 81 contacts the forward end of the latch member 80 during closing of the vending machine door 10. In previous vending machines, such as the vending machine of my prior U.S. Pat. No. 3,884,330, the impact force between the keeper and the forward end of the latch member has, in many instances, caused permanent deformation of the latch member or the support for the latch member. For example, when the door for the vending machine is slammed shut, the forward end of the latch member may receive a considerable impact force from the keeper, which may cause bending of either the latch member or the support for the latch member so that the latch member does not engage the keeper when the vending machine door is closed.

The latch member support 104 which may be employed in the present invention is especially designed to resist bending caused by forces exerted against the leading end of the support by the latch member 80. As indicated, the depth of the side members 142 gradually increases in a direction toward the door 10 from the point of connection between the latch member support 104 and the latch member 80. Thus, the cross-sectional area of the side members 142 and the support 104 is greatest at a point on the support which is positioned most closely to the door panel 102. The bending forces exerted on the support 104 increase as the moment arm of the bending force is increased, i.e., in a direction proceeding toward the door 10. However, since the cross section of the latch member support 104 is greatest at a point adjacent to the door panel 102, the latch member support provides a progressive increase in resistance to bending forces in a direction toward the door panel 102 from the point of connection between the latch member support and the latch member 80. Thus, the configuration of the latch member support 104 is most advantageous in maintaining the position of the latch member 80 relatively constant with respect to that of the keeper 81 over a prolonged period of usage of the vending machine. This insures that the latch member 80 will continue to function in its desired manner to provide a locking action between the latch member and keeper 81, even though the vending machine is subjected to continued abuse by slamming of the vending machine door 10.

I claim:

1. In a vending machine having an enclosure for articles to be vended, a lockable door to said enclosure, and a coin operated locking mechanism to unlock said door when a predetermined combination of coins is received by said mechanism, the improvement comprising:

a coin mechanism enclosure;

releasable support means within the coin mechanism enclosure which is engagable with said coin mechanism to hold the coin mechanism in a predetermined position within the coin mechanism enclosure to control the opening of said door;

means to release said support means to permit the removal of said coin mechanism from the coin mechanism enclosure;

said means to release said support means including a locking member which is movable between a locking position and an unlocking position;

said locking member in its locking position exerting a force against the coin operated locking mechanism to move said mechanism into fixed engagement with said support means with the coin mechanism in its predetermined position to control opening of said door;

said locking member in its unlocking position permitting the movement of the coin mechanism out of fixed engagement with said support means to permit the removal of the coin mechanism from the coin mechanism enclosure;

said locking member being mounted on the coin mechanism enclosure, and said locking member having a cam surface which contacts the coin mechanism to move the coin mechanism into fixed engagement with the support means when said locking member is moved to its locking position.

2. In a vending machine having an enclosure for articles to be vended, a lockable door to said enclosure, and a coin operated locking mechanism to unlock said door when a predetermined combination of coins is received by said mechanism, the improvement comprising:

a coin mechanism enclosure;

releasable support means within the coin mechanism enclosure which is engagable with said coin mechanism to hold the coin mechanism in a predetermined position within the coin mechanism enclosure to control the opening of said door;

means to release said support means to permit the removal of said coin mechanism from the coin mechanism enclosure;

said means to release said support means including a locking member which is movable between a locking position and an unlocking position;

said locking member in its locking position exerting a force against the coin operated locking mechanism to move said mechanism into fixed engagement with said support means with the coin mechanism in its predetermined position to control opening of said door;

said locking member in its unlocking position permitting the movement of the coin mechanism out of fixed engagement with said support means to permit the removal of the coin mechanism from the coin mechanism enclosure;

said support means including support posts positioned with respect to said coin mechanism enclosure;

apertures in said coin operated mechanism to engage said support posts;

said apertures having a configuration which fixedly engages the support posts when the coin mechanism is shifted in one direction with respect to the support posts;

the configuration of said apertures permitting disengagement of the apertures from the support posts when the coin mechanism is shifted in another direction with respect to the support posts;

said locking member being mounted on the coin mechanism enclosure, and said locking member having a cam surface which contacts the coin mechanism to move the coin mechanism in said one direction with respect to the support posts and to move said apertures into fixed engagement with the support posts.

3. In a vending machine having an enclosure for articles to be vended, a lockable door to said enclosure, and a coin operated locking mechanism to unlock said door when a predetermined combination of coins is received by said mechanism, the improvement comprising:

a coin mechanism enclosure;

releasable support means within the coin mechanism enclosure which is engagable with said coin mechanism to hold the coin mechanism in a predetermined position within the coin mechanism enclosure to control the opening of said door;

means to release said support means to permit the removal of said coin mechanism from the coin mechanism enclosure;

a latch member on said door;

a keeper member in said coin operated locking mechanism;

said latch member engaging said keeper member with the door in a locked position;

said coin mechanism including a coin chute to retain a plurality of coins in a columnar relation;

means to prevent upward movement of said plurality of coins within said chute when a predetermined number of coins of predetermined denomination have been inserted into said chute;

cam means on said latch member which contact the lowermost coin of said plurality of coins to move the latch member away from said keeper member when the predetermined number of coins of predetermined denomination have been inserted into said chute and to permit opening of said door, and said releasable support means positioning said coin mechanism within the coin mechanism enclosure with said keeper member and said coin chute in a predetermined relation with respect to the latch member to provide engagement between the keeper member and the latch member with said door in a locked condition while permitting opening of the door when a predetermined number of coins of predetermined denomination have been inserted into said chute.

4. The vending machine of claim 3 wherein said means to prevent upward movement of said plurality of coins within said chute include a plurality of pawls;

said pawls being mounted for movement into said chute to engage the uppermost coin of said plurality of coins when the predetermined number of coins of predetermined denomination have been inserted into said chute, and releasable control means to change the position of the pawls relative to said chute so as to vary the number and denomination of coins required to open said door;

said releasable control means engaging said pawls when the coin mechanism is in engagement with said support means, and said releasable control being disengaged from said pawls when the coin mechanism is moved out of engagement with the support means in removal of the coin mechanism from the coin mechanism enclosure.

5. In a vending machine having an enclosure for articles to be vended, a lockable door to said enclosure, and a coin operated locking mechanism to unlock said door when a predetermined combination of coins is received by said mechanism, the improvement comprising:

a coin mechanism enclosure;

releasable support means within the coin mechanism enclosure which is engagable with said coin mechanism to hold the coin mechanism in a predetermined position within the coin mechanism enclosure to control the opening of said door;

means to release said support means to permit the removal of said coin mechanism from the coin mechanism enclosure;

said mean to release said support means including a locking member which is movable between a locking position and an unlocking position;

said locking member in its locking position exerting a force against the coin operated locking mechanism to move said mechanism into fixed engagement with said support means with the coin mechanism in its predetermined position to control opening of said door;

said locking member in its unlocking position permitting the movement of the coin mechanism out of fixed engagement with said support means to permit the removal of the coin mechanism from the coin mechanism enclosure;

a latch member on said door;

a keeper member in said coin operated locking mechanism;

said latch member engaging said keeper member with the door in a locked position;

said coin mechanism including a coin chute to retain a plurality of coins in a columnar relation;

means to prevent upward movement of said plurality of coins within said chute when a predetermined number of coins of predetermined denomination have been inserted into said chute;

cam means on said latch member which contacts the lowermost coin of said plurality of coins to move the latch member away from said keeper member when the predetermined number of coins of predetermined denomination have been inserted into said chute to permit opening of the door, and said locking member contacting the coin mechanism within the coin mechanism enclosure to position said keeper member and said coin chute in a predetermined relation with respect to the latch member for engagement of the keeper member with the latch member with the door in a locked condition while permitting the door to be opened when a predetermined number of coins of predetermined denomination have been inserted into said coin chute.

6. The vending machine of claim 5 wherein said means to prevent upward movement of said plurality of coins within said coin chute includes a plurality of pawls within said coin mechanism, said pawls being positioned for movement into the coin chute to engage the uppermost coin of said plurality of coins when the predetermined number of coins of predetermined denomination have been inserted into the chute to prevent upward movement of the pluraltiy of coins, and releasable control means to change the position of the pawls with respect to the coin chute so to vary the predetermined number and denomination of coins which are required to unlock said door;

said releasable control means engaging the pawls when the coin mechanism is in fixed engagement with said support means, and said releasable means being disengaged from said pawls when the coin mechanism is moved out of engagement with the support means in removal of the coin mechanism from the coin mechanism enclosure.

7. The vending machine of claim 3 including a support member on said door;

said latch member being movably supported by said support member, and said support member having a cross-sectional configuration which has a relatively high resistance to bending by contact of the latch member with the keeper, whereby the position of the latch member relative to the keeper member with the door in a closed position is maintained relatively constant during long-term usage of the vending machine.

8. The vending machine of claim 7 wherein said support member has a generally U-shaped cross section having spaced-apart legs, and said latch member is rotatably mounted between said legs.

9. The vending machine of claim 8 including spring means resiliently biasing said latch member into contact with the keeper with the door in a locked condition.

10. The vending machine of claim 7 wherein the cross sectional area of the support member progressively increases in the direction of said door from the point of connection between the support member and the latch member.

11. The vending machine of claim 8 wherein said legs have a depth which is non-uniform with the depth of said legs progressively increasing in the direction of the vending machine door, and said latch member being mounted on the distal end of said support bracket, whereby the bending forces of increasing magnitude applied to the support member through the latch member are resisted by the progressively increasing depth of said legs which provide a progressively increasing resistance to bending of the support member.

12. The vending machine of claim 7 including an inclined surface on the distal end of the latch member;

said inclined surface contacting said keeper during closing of said door to provide a deflecting force on the latch member which permits the latch member to slide over the keeper while minimizing the force of impact between the keeper and the distal end of the latch member.

13. The vending machine of claim 10 including an inclined surface on the distal end of the latch member;

said inclined surface contacting said keeper during closing of said door to provide a deflecting force on the latch member which permits the latch member to slide over the keeper while minimizing the force of impact between the keeper and the distal end of the latch member.

14. A vending machine having an enclosure for articles to be vended, a lockable door to said enclosure, and a coin-operated locking mechanism to unlock said door when a predetermined combination of coins is received by said mechanism, the improvement comprising:

a coin mechanism enclosure;

releasable support means within the coin mechanism enclosure which is engageable with said coin mechanism to hold the coin mechanism in a predetermined position within the coin mechanism enclosure to control the opening of said door;

rotatable locking means having an arcuate cam surface to release said coin mechanism from said support means and to permit the removal of said coin mechanism from the coin mechanism enclosure, and said rotatable locking means being movable between a locking position in which the cam surface exerts a locking side force against the coin mechanism which fixes the position of the coin mechanism with respect to the releasable support means and an unlocking position in which the cam surface is moved out of contact with the coin mechanism to release the coin mechanism from fixed engagement with the releasable support means, whereby the coin mechanism may be removed from the coin mechanism enclosure for servicing and another coin-operated locking mechanism may be positioned within the coin mechanism enclosure in fixed engagement with said releasable support means to control the opening of said door.

15. In a vending machine having an enclosure for articles to be vended, a lockable door to said enclosure, and a coin-operated mechanism to unlock said door when a predetermined combination of coins is received by said mechanism, the improvement comprising:

a coin mechanism enclosure;

releasable support means within the coin mechanism enclosure which is engageable with the coin mechanism to hold the coin mechanism in a predetermined position within the coin mechanism enclosure to control the opening of said door;

rotatable locking means to release said coin mechanism from said support means and to permit the removal of said coin mechanism from said coin mechanism enclosure;

said rotatable locking means being movable between a locking position in which the rotatable locking means exerts a force against the coin mechanism which fixes the position of the coin mechanism with respect to the releasable support means and an unlocking position which releases the coin mechanism from fixed engagement with the releasable support means;

said support means including support posts fixedly positioned with respect to the coin mechanism enclosure;

apertures in said coin-operated mechanism for engagement with said support posts;

said apertures having a configuration which fixedly engages the support posts when the coin mechanism is positioned with respect to the support posts by the rotatable locking means, and the configuration of said apertures permitting disengagement of the apertures from the support posts when the rotatable locking means is moved to an unlocking position, whereby the coin mechanism may be removed from the coin mechanism enclosure for servicing and another coin-operated locking mechanism may be positioned within the coin mechanism enclosure in fixed engagement with said releasable support means to control the opening of said door.

* * * * *